US008215378B2

(12) United States Patent
Nash et al.

(10) Patent No.: US 8,215,378 B2
(45) Date of Patent: Jul. 10, 2012

(54) HEAT EXCHANGER WITH PRESSURE AND THERMAL STRAIN MANAGEMENT

(75) Inventors: James S. Nash, North Hampton, NH (US); James B. Kesseli, Greenland, NH (US); Antoine H. Corbeil, Gatineau (CA)

(73) Assignee: Brayton Energy, LLC, Hampton, NH (US)

( * ) Notice: Subject to any disclaimer, the term of this patent is extended or adjusted under 35 U.S.C. 154(b) by 1046 days.

(21) Appl. No.: 12/115,219

(22) Filed: May 5, 2008

(65) Prior Publication Data

US 2009/0211739 A1 Aug. 27, 2009

Related U.S. Application Data

(60) Provisional application No. 60/927,343, filed on May 3, 2007.

(51) Int. Cl.
*F28F 3/00* (2006.01)
*F28F 7/00* (2006.01)

(52) U.S. Cl. ..... 165/82; 165/166

(58) Field of Classification Search ..... 165/151, 165/152, 153, 165, 166, 167, 168, 170, 81, 165/82
See application file for complete search history.

(56) References Cited

U.S. PATENT DOCUMENTS

| | | | | |
|---|---|---|---|---|
| 2,617,634 | A * | 11/1952 | Jendrassik | 165/140 |
| 3,117,624 | A * | 1/1964 | Wennerberg | 165/167 |
| 3,444,926 | A * | 5/1969 | Stalberg | 165/166 |
| 3,460,611 | A | 8/1969 | Folsom et al. | |
| 4,073,340 | A * | 2/1978 | Parker | 165/166 |
| 4,229,868 | A | 10/1980 | Kretzinger | |
| 4,258,784 | A | 3/1981 | Perry et al. | |
| 4,291,752 | A * | 9/1981 | Bridgnell | 165/81 |
| 4,815,534 | A | 3/1989 | Fuerschbach | |
| 5,983,992 | A | 11/1999 | Child et al. | |
| 6,283,199 | B1 * | 9/2001 | Nakamura et al. | 165/81 |
| 6,305,079 | B1 | 10/2001 | Child et al. | |
| 7,013,963 | B2 * | 3/2006 | Laine et al. | 165/157 |
| 2001/0025705 | A1 | 10/2001 | Nash et al. | |
| 2002/0026999 | A1 | 3/2002 | Wu et al. | |
| 2002/0174978 | A1 * | 11/2002 | Beddome et al. | 165/174 |
| 2003/0024696 | A1 | 2/2003 | Haplau-Colan et al. | |
| 2003/0047303 | A1 * | 3/2003 | Andersson | 165/167 |
| 2009/0211740 | A1 | 8/2009 | Kesseli et al. | |

FOREIGN PATENT DOCUMENTS

| | | |
|---|---|---|
| FR | 1494167 A | 9/1967 |
| GB | 1062241 A | 3/1967 |
| GB | 1197449 A | 7/1970 |
| GB | 1304692 A | 1/1973 |

OTHER PUBLICATIONS

PCT International Search Report and Written Opinion received in PCT/US2009/042835, dated Jul. 7, 2009.
PCT International Search Report and Written Opinion received in PCT/US2009/042849, dated Jul. 2, 2009.

* cited by examiner

*Primary Examiner* — Tho V Duong
(74) *Attorney, Agent, or Firm* — McLane, Graf, Raulerson & Middleton, Professional Association

(57) ABSTRACT

A heat exchange device of a type for affecting an exchange of heat between a first and second fluid is characterized by a plurality of heat exchange cells in a stacked arrangement and defining first, second and third manifolds. In certain aspects, an apparatus and method for reinforcing the heat exchange device against pressure loads while accommodating thermal expansion of the outlet manifold are provided.

13 Claims, 5 Drawing Sheets

HEAT EXCHANGER WITH PRESSURE AND THERMAL STRAIN MANAGEMENT

CROSS REFERENCE TO RELATED APPLICATION

This application claims the benefit of priority under 35 U.S.C. §119(e) to U.S. provisional application Ser. No. 60/927,343 filed May 3, 2007. The aforementioned application is incorporated herein by reference in its entirety.

BACKGROUND

This disclosure relates generally to heat exchangers with features directed to various innovations including ones relating to gas turbine recuperators.

The recuperation of the gas turbine engine is a proven method for increasing thermal efficiency in gas turbines. However, the technical challenges associated with surviving the severe environment of a gas turbine exhaust while meeting the equally severe cost challenges has limited the number of viable products. A gas turbine recuperator is typically exposed to a thermal gradient of up to 600 C, pressures of 3 to 22 bar, and may operate at a gas temperature of over 700 C. Moreover, developers of advanced recuperated gas turbine systems are considering applications with pressures of up to 80 bar and temperatures ranging to 1000 C.

The successful design must tolerate severe thermal gradients, and repeated thermal cycling, by allowing unrestricted thermal strain. The structural requirements to manage very high pressures tend to work against the normal design preferences for structural flexibility, which is important to tolerating large and rapid thermal transients. Often the thermal-strain tolerant heat exchanger core requires a case and internal structures to manage the internal pressure loads. In one aspect, the subject disclosure is directed to a heat exchange device and system using a unique three manifold arrangement. In a further aspect, the present disclosure is directed to a heat exchange device and system with a separate but integrated pressure and thermal management structure.

SUMMARY

In one aspect, a heat exchange device for effecting a transfer of heat between a first fluid and a second fluid is provided. The heat exchange device includes a plurality of heat exchange cells in a stacked arrangement and defines a first manifold, a second manifold, and a third manifold disposed intermediate the first and second manifolds. Each of the heat exchange cells comprises an upper cell plate having an exterior facing surface and an interior facing surface opposite the exterior facing surface, first, second, and third upper manifold apertures, and an upper peripheral edge bounding the upper cell plate. A lower cell plate has an exterior facing surface and an interior facing surface opposite the exterior facing surface, first, second, and third lower manifold apertures, and a lower peripheral edge bounding the lower cell plate. The lower cell plate is juxtaposed with the upper cell plate so that the first lower manifold aperture is aligned with the first upper manifold aperture, the second lower manifold aperture is aligned with the second upper manifold aperture, and the third lower manifold aperture is aligned with the third upper manifold aperture. The upper peripheral edge is joined to the lower peripheral edge to define a cell peripheral edge. The interior facing surface of the upper cell plate faces and is spaced apart from the interior facing surface of the lower cell plate to define a first interior volume extending between the first manifold and the third manifold and a second interior volume extending between the second manifold and the third manifold. The first interior volume has a first cell inlet and a first cell outlet and defines a first fluid passageway for the first fluid between the first cell inlet and the first cell outlet. The second interior volume has a second cell inlet and a second cell outlet and defines a second fluid passageway for the first fluid between the second cell inlet and the second cell outlet. A first heat transfer matrix is positioned within the first interior volume and a second heat transfer matrix is positioned within the second interior volume. A third heat transfer matrix is attached to the exterior surface of the upper cell plate between the first upper manifold aperture and the third upper manifold aperture and a fourth heat transfer matrix is attached to the exterior surface of the upper cell plate between the second upper manifold aperture and the third upper manifold aperture. A fifth heat transfer matrix is attached to the exterior surface of the lower cell plate between the first lower manifold aperture and the third lower manifold aperture and a sixth heat transfer matrix is attached to the exterior surface of the lower cell plate between the second lower manifold aperture and the third lower manifold aperture. A first upper manifold ring on the exterior surface of the upper cell plate circumscribes the first upper manifold aperture. A second upper manifold ring on the exterior surface of the upper cell plate circumscribes the second upper manifold aperture. A third outlet manifold ring attached to the exterior surface of the upper plate circumscribes the third upper manifold aperture. A first lower manifold ring attached to the exterior surface of the lower plate circumscribes the first lower manifold aperture. A second lower manifold ring attached to the exterior surface of the lower plate circumscribes the second lower manifold aperture. A third lower manifold ring attached to the exterior surface of the lower plate circumscribes the third lower manifold aperture.

In another aspect, a method of reinforcing a heat exchange device of a type comprising a plurality of heat exchange cells in a stacked arrangement and defining first and second manifolds and a third manifold intermediate the first and second manifolds is provided. Each of the manifolds has a closed end and an open end opposite the closed end. The method includes reinforcing the first and second manifolds to prevent gross distortion of the first and second manifolds when the first and second manifolds are subjected to a pressure load. A first end of a lateral beam is coupled to the closed end of the first manifold and a second end of the lateral beam is coupled to the closed end of the second manifold, such that the closed end bears against the lateral beam at a position intermediate the first and second ends of the lateral beam.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

While not intending to be limitative, the subject disclosure provides a heat exchange device which is particularly well suited for high temperature and pressure applications.

Figure 1:
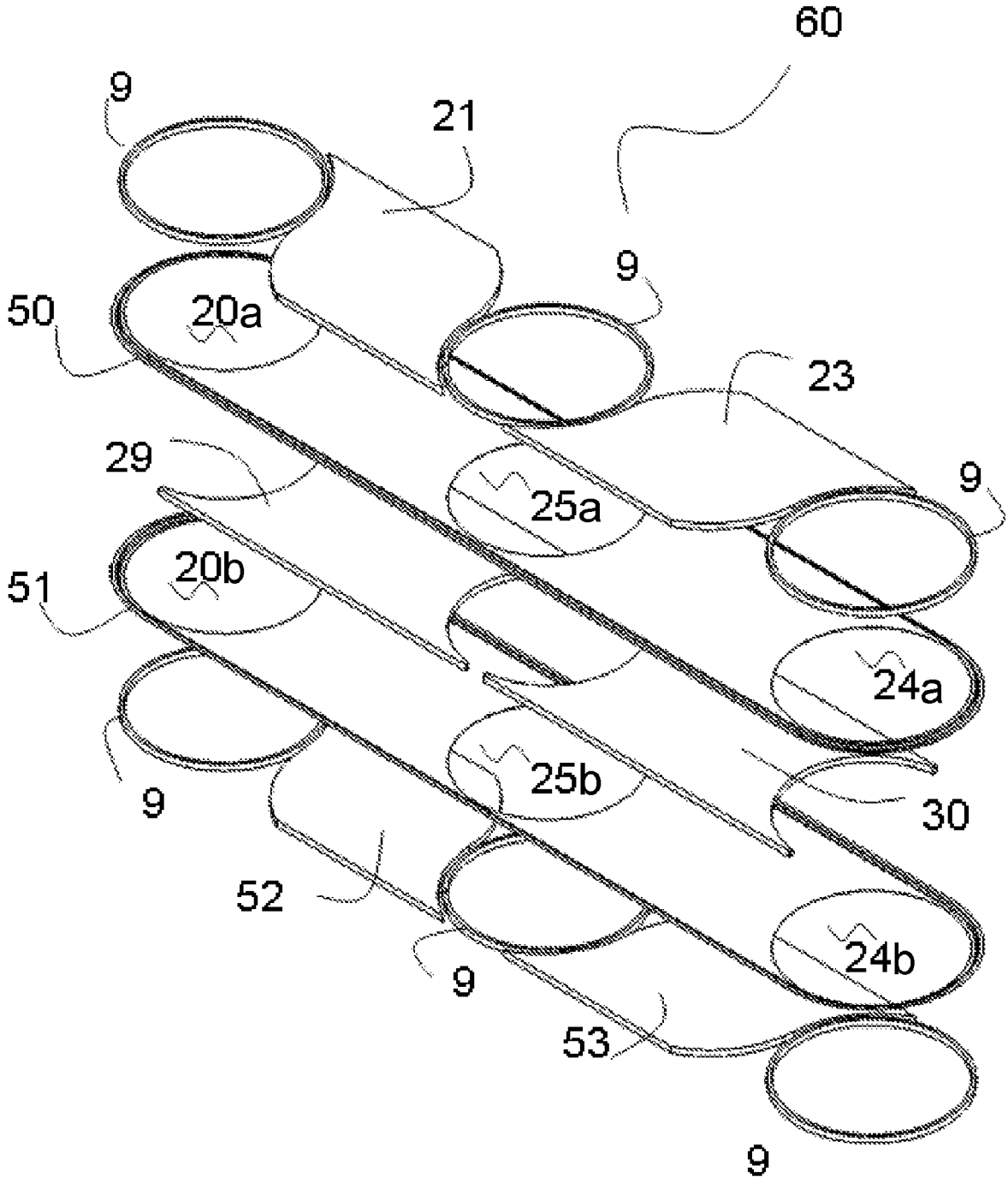
FIG. 1 is an exploded view of a cellular heat exchanger element in accordance with an exemplary embodiment.
Figure 2:
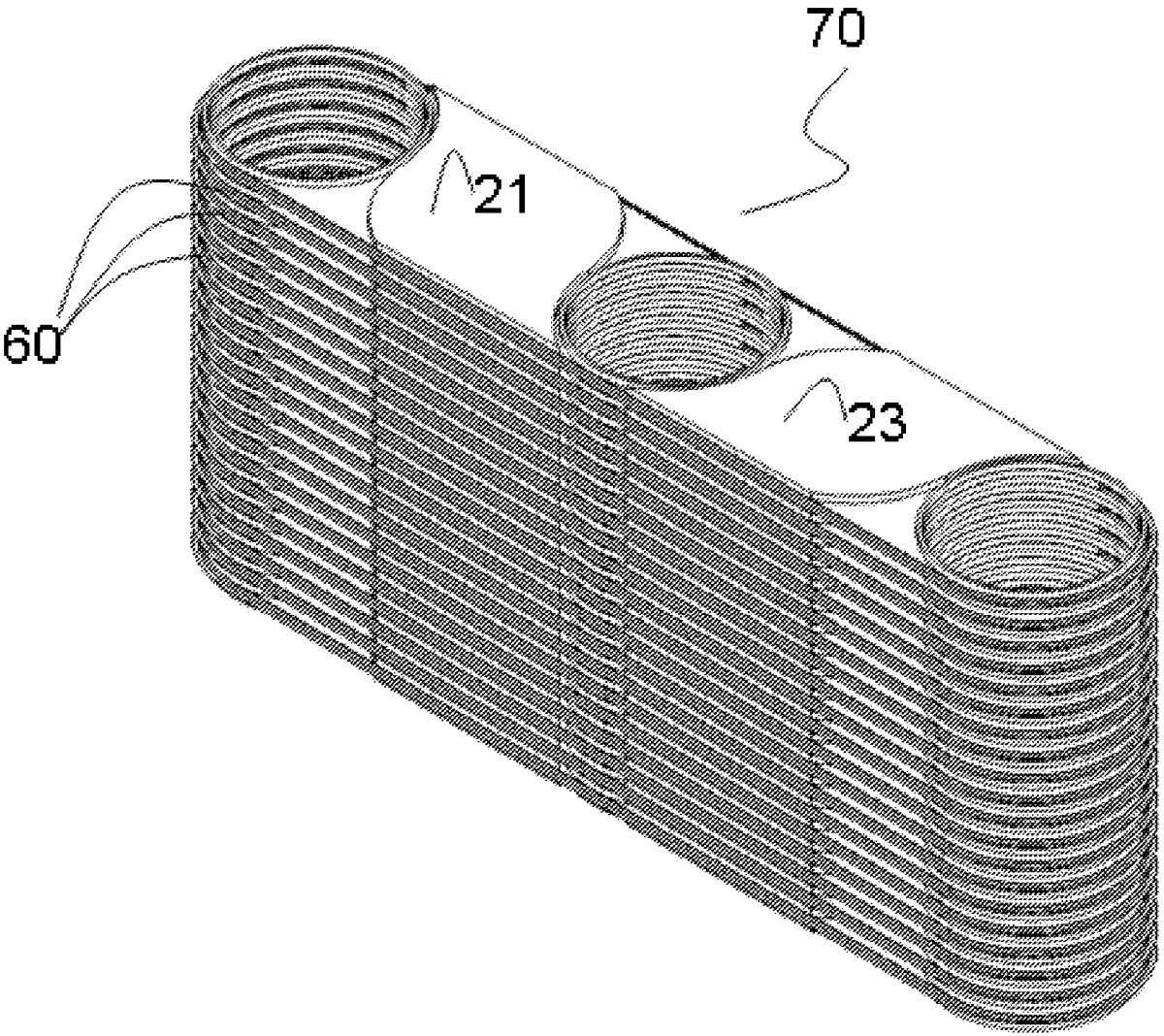
FIG. 2 is an isometric view illustrating a stacked array of heat exchanger cellular elements, forming a heat exchanger core.

With reference to the drawings, wherein like reference numerals are used to depict like or similar components throughout the several views, FIG. 1 shows a heat exchange cellular element 60 in accordance with an exemplary embodiment. As shown in FIG. 2, a heat exchange core 70 is formed by stacking a plurality of heat exchange cells 60 to form a stacked array. The heat exchange core 70 may be comprised of any number of cells 60, for example, ranging from 2 to several hundred or more.

Each cellular element 60 is comprised of a first or upper (in the orientation shown) cell plate 50 and a second or lower cell plate 51, which is a mirror image of the first cell plate 50 and which has identical planar dimensions (i.e., "footprint") and thickness features. The upper plate 50 is shown with three circular cutouts or apertures 20*a*, 24*a*, and 25*a*. The aperture 20*a* is a first upper inlet aperture and the aperture 24*a* is a second upper inlet aperture. The aperture 25*a* is an upper outlet aperture. The aperture 20*b* is a first lower inlet aperture and the aperture 24*a* is a second lower inlet aperture. The aperture 25*b* is a lower outlet aperture.

Interposed within the interior volume defined between the plates 50 may be a secondary thermally conductive surface or heat transfer matrix. In the depicted embodiment, a first heat transfer matrix 29 is disposed between the first inlet apertures 20*a*, 20*b* and the outlet apertures 25*a*, 25*b*. A second matrix 30 is disposed between the second inlet apertures 24*a*, 24*b* and the outlet apertures 25*a*, 25*b*. The matrices 29, 30, may be in the form of folded fin matrices, screens, porous media, or other heat exchange matrix types as are known in the art for the purpose of increasing heat exchange.

When the upper plate 50 and lower plate 51 are placed in substantial alignment, matching the mirror image periphery of the plates 50, 51 and centering the upper manifold cut-outs 20*a*, 24*a*, and 25*a* with the lower manifold cut-outs 20*b*, 24*b*, and 25*b*, respectively, a cell perimeter 33 (see FIG. 3A) of the cell 60 is formed. A seal for the first fluid, around the perimeter 33 may be made by forming or rolling a generally dish-like flange into each of said plates 50 and 51, where said dish-like flanges are mirror images of one another and which may be bonded, e.g., metallurgically bonded. Alternatively, other edge sealing methods as would be known to those skilled in the design of heat exchanger devices may be employed, such as a peripheral edge bar for joining the upper and lower plates together in spaced apart relation.

Third and forth heat transfer matrices 21 and 23, respectively, are affixed to the external surface of the plate 50 on opposite sides of the manifold cutout 25*a* to provide enhanced heat transfer. Also, like heat transfer matrices 52 and 53 are affixed to the exterior surface of the plate 51 on opposite sides of the aperture 25*b*. The heat transfer matrices may be, for example, a folded or corrugated sheet metal material, dimpled sheet, sintered porous media, expanded metal foam, a screen pack, or any other surface fin material as would be known to persons skilled in the art.

Spacer rings 9, having an inner diameter approximately equal to the diameter of manifold cut-outs 20*a*, 20*b*, 24*a*, 24*b*, 25*a*, and 25*b* have an axial thickness which is approximately equal to the thickness of the matrix elements 21, 23, 52, and 53. Three manifold rings 9 are affixed to the exterior-facing surface of the upper plate 50, circumscribing each of the manifold apertures 20*a*, 24*a*, and 25*a*. Likewise, three manifold rings 9 are affixed on the exterior facing surface of the lower plate 51, circumscribing each of the manifold apertures 20*b*, 24*b*, and 25*b*. The aforementioned plates, heat transfer matrices, and manifold rings, when bonded together, form the unit cell 60. In the case of a metallic construction, a metallurgical bonding method such as brazing, diffusion bonding, welding, or soldering may be employed. In construction from ceramic materials, a sintering or high temperature cementing process may be employed.

The final assembly of a heat exchanger core 70, which comprises a stacked plurality of cells 60, is produced by bonding the plurality of cells 70 together at the surface of contact between contacting reinforcing rings 10 and 12 and between the surfaces of contact between the contacting manifold rings 9 on adjacent cells in the stacked array. The exterior matrix members 23, 23, 52, and 53 contact but are not bonded to the corresponding aligned and facing exterior matrix member on adjacent cells 60, but may bear on one another. When stacking the plurality of cells 60, the manifold segments 9 are arranged to be in substantial vertical alignment with the respective manifold cutouts 20*a*, 20*b*, 24*a*, 24*b*, 25*a*, 25*b*, and are positioned to form a seal between cells around the manifolds.

The conduit defined by the cutouts 20*a* and 20*b* and the corresponding attached manifold rings 9 forms a first inlet manifold 120 for the fluid entering the heat exchanger core 70. The conduit defined by the cutouts 24*a* and 24*b* and the corresponding attached manifold rings 9 forms a second inlet manifold 124 for the fluid entering the heat exchanger core 70. The conduit defined by the cutouts 25*a*, 25*b* and the corresponding attached manifold rings 9 serves as an outlet manifold 125 for fluid exiting the heat exchanger core 70. Because the contact surfaces between the exterior matrix elements of adjacent cells 60 are not bonded, the cells 60 present little resistance to the independent thermal growth between the manifold stacks.

The assembled heat exchanger including the heat exchange core 70 further includes external ducting 41, 42 (see FIG. 4) surrounding the core for directing the flow of the low pressure heat exchange medium through the external heat exchange matrices 21, 23, 52, and 53. The external ducting 42 receiving the heat exchange core 70 may be of any known or conventional type as would be understood by persons skilled in the art.

Figures 3A, 3B, 3C:
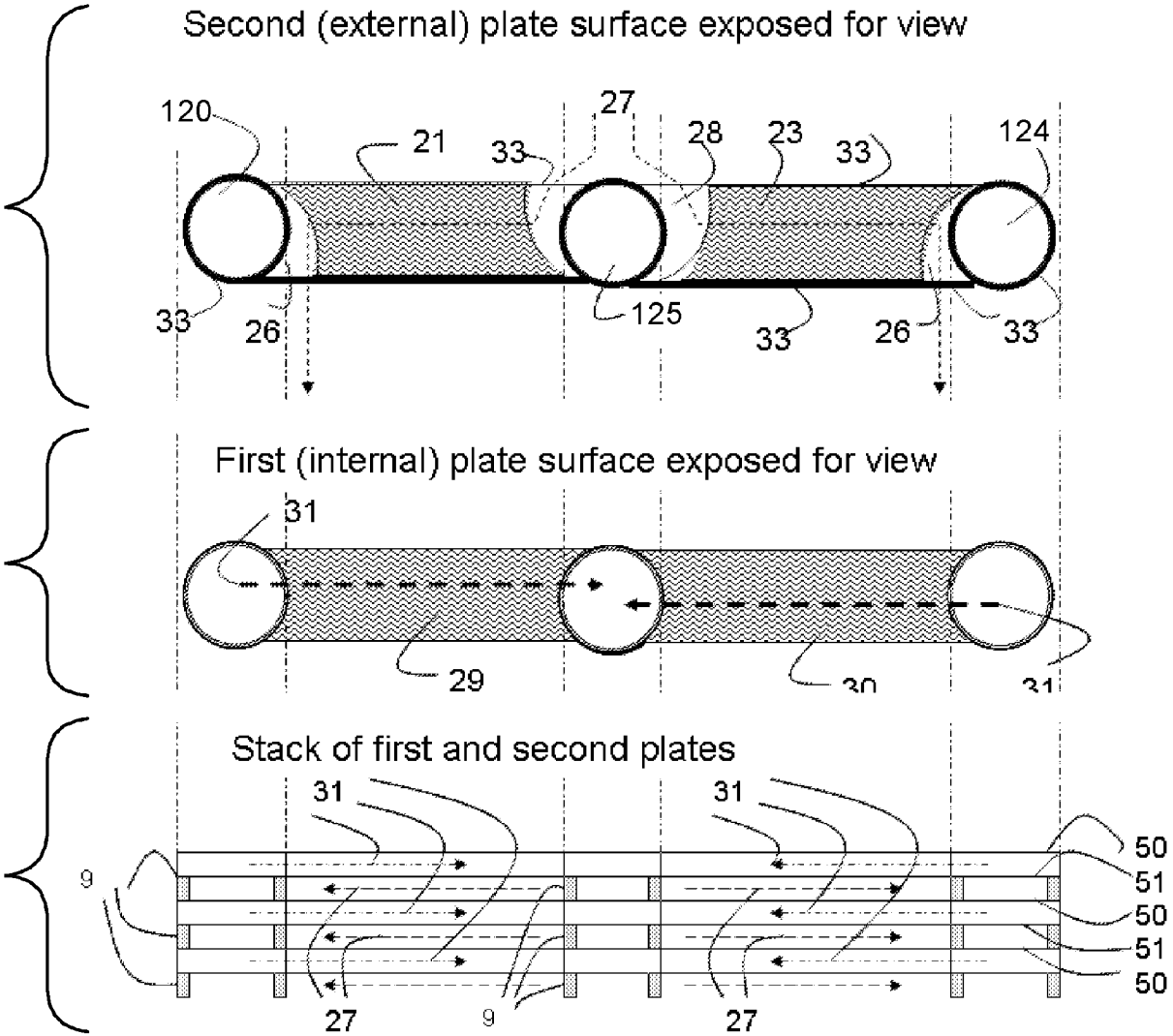
FIG. 3A is a top plan view of an exemplary heat exchange cell with an external plate surface exposed, showing the flow path of a first heat exchange fluid.
FIG. 3B is a top plan view of the exemplary heat exchange cell shown in FIG. 3A, with an internal plate surface exposed, showing the flow path of a second heat exchange fluid.
FIG. 3C is a somewhat schematic side cross-sectional view of a stack of heat exchange cells of the type shown in the embodiment appearing in FIGS. 3A and 3B illustrating flow of the heat exchange first and second heat exchange media.

In operation, as best seen in FIGS. 3B and 3C, a first fluid 31 enters the manifolds 120, 124, on opposite ends of the core 70, and flows inward, passing through the interior matrices 29, 30 and collects in the central outlet manifold 125. As best seen in FIG. 3A, second fluid 27 passes through the exterior, low-pressure matrices 21, 23, 52, and 53 on the exterior surfaces of the plates 50 and 51.

The second fluid 27 enters from a direction normal to the flow path of the first fluid 31, splits around the exterior of the manifold 125 and flows over lands 28 on opposite sides of the center manifold 125. The second fluid 27 flows through the heat exchange matrices 21 and 23 as well as 52 and 53 (see FIG. 1) and collects in lands 26 adjacent each of the first and second inlet manifolds 120 and 124 before exiting the cell 60 and core 70. The lands 26 and 28 may be regions on the exterior facing surfaces of the plates 50 and 51 which are free of the exterior matrix material to provide an entrance to and exit from the corresponding matrix elements 21, 23, 52, and 53 for the second fluid. Alternatively, the lands 26, 28 may be a secondary heat exchange matrix adapted to direct the second fluid into the respective matrices 21, 23, 52, and 53.

In the depicted embodiment of FIG. 3A the lands 28 are on opposite transverse sides of the heat exchange cell as the lands 26 and are axially displaced from the lands 26, so as to provide a generally Z-shaped flow path. It will be recognized that other configurations are possible. For example, a generally C-shaped flow path may be provided by axially spacing apart the lands 26 and 28 on the same transverse side of the heat exchange cell. Likewise, flow may be admitted simultaneously into the cell from both transverse sides of the heat exchange cell by squaring off the matrix elements 21, 23, 52, and 53, yielding symmetrical lands 26 and 28.

Figure 4:
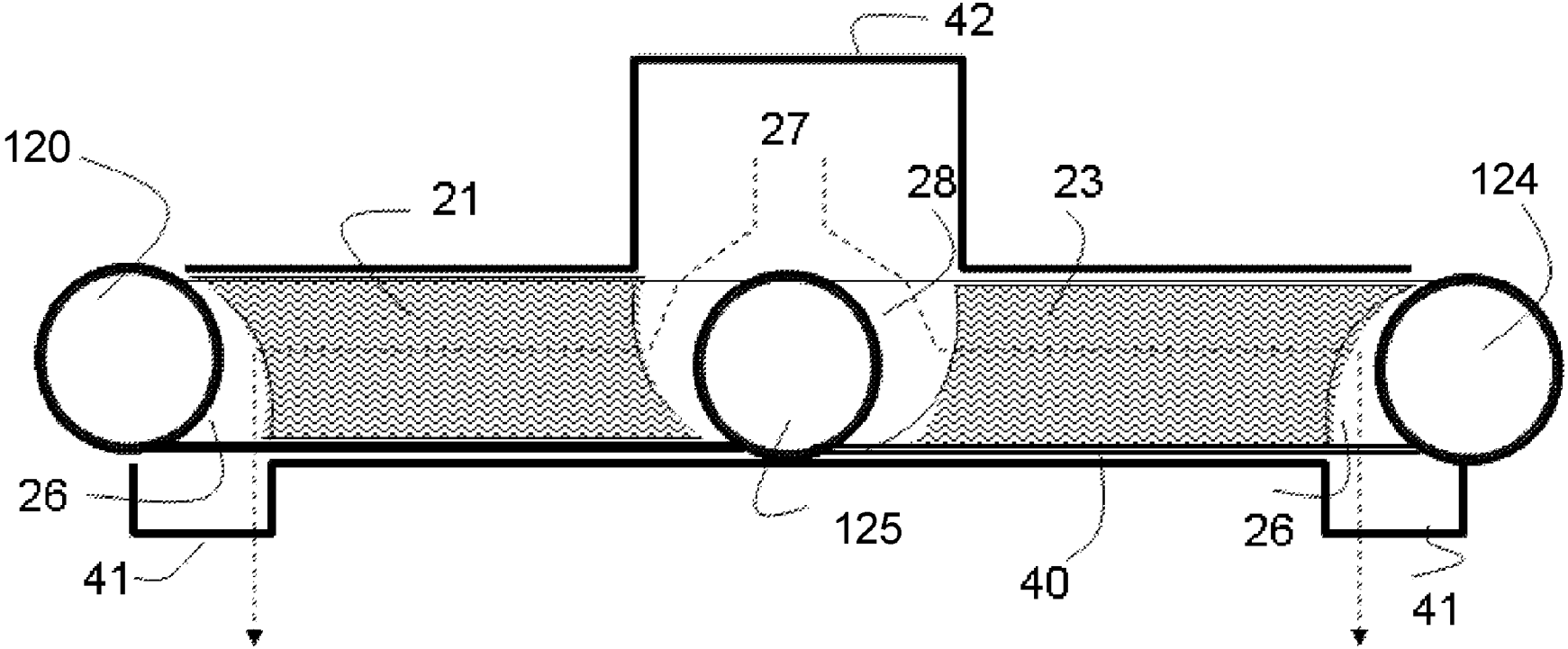
FIG. 4 is a top plan view of an exemplary heat exchange device herein, with surrounding ducting for delivering the external or low pressure heat exchange fluid.

The duct work 42 may be attached to or pressed against the heat exchanger core 70 to collect and guide the second fluid 27. In FIG. 4, an inlet duct 40 is attached or pressed against the edge of the cellular stack 70, forming headers or collectors 41 for the exiting second fluid 27. Likewise, a duct 42 is attached to or pressed against the opposite edge of said core stack, forming an inlet plenum to deliver said second fluid 27 to the land 28 entrance to the core 70.

The first fluid 31 may be a low temperature, high-pressure fluid and the second fluid 27 may be a high temperature, low-pressure fluid. By way of example, waste heat in a relatively low-pressure fluid 27 can be recovered via thermal transfer to a high-pressure 31 fluid passing through the interior matrices 29, 30 within the interior volumes of the heat exchange cells 60. In a preferred embodiment, the first fluid 31 may be a working fluid such as compressed air for expansion through the turbine stage of a turbomachine, for example, to generate electrical and/or rotary shaft power and the second fluid 27 may be high-temperature, low-pressure turbine exhaust gas. Preferably, as best seen in FIG. 3C, the second fluid flows over the external surfaces of the envelope of plates 50 and 51, in a counter-flow or cross-flow orientation to the flow direction of said first fluid. Although the depicted manifold spacer segments 9 are shown as being rings affixed to the external surface of plates 50, 51 to segregate the first and second fluids in the manifold region, it will be recognized that the separate manifold rings 9 may alternatively be integral with the respective plates 50, 51, e.g., stamped, machined, or otherwise formed as a feature on said plates 50, 51.

The previously described heat exchanger core may require additional structural support if the first fluid 31 is at an elevated pressure relative to the second fluid 27. Commonly, this may be accomplished through the use of tension bars or tie-bar, or a surrounding structural case. This technical challenge is further complicated when the second fluid inlet and first fluid outlet temperature are at a high temperature where creep and oxidation are pronounced. Such a temperature threshold is known to those working in this field to be in the range of about 500 to 1000 C (900 to 1800 F) for metallic alloys. For example, the expansion associated with a 500 C differential between the low temperature manifolds 120, 124 and the center high temperature manifold 125 may be approximately 7 mm (0.27 in). If rigidly restrained, this strain could result in damaging stress levels within the core 70.

Figure 5:
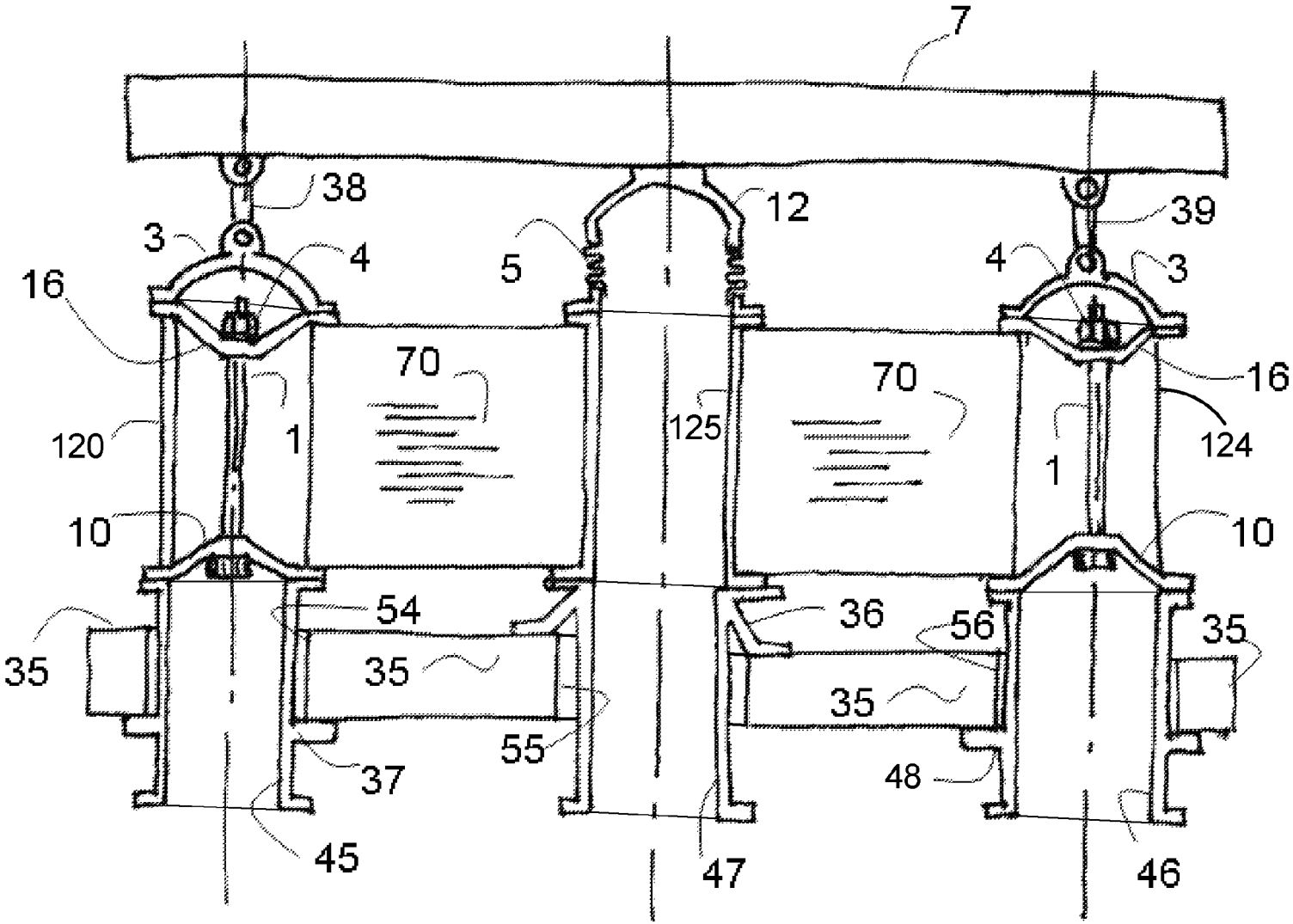
FIG. 5 is a side cross-sectional view of an exemplary pressure management for controlling the internal pressure loads exerted on the heat exchange core while also accommodating thermal growth of the heat exchange core.

FIG. 5 describes an improved system for restraining deflection in the core stack 70 caused by the pressure loads exerted through the manifolds 120, 124, 125. Again, the manifolds are defined by the stacking plates 50 and 51, aligned cut-outs 20*a*, 20*b*, 24*a*, 24*b*, 25*a*, and 25*b* and corresponding aligned separator rings 9. These components are metallurgically bonded to form the manifolds 120, 124, 125. In addition, the restraining device illustrated and described manages the significant differential thermal expansion of the hot outlet manifold 125 relative to the cool inlet manifolds 120, 124.

FIG. 5 is a side cross-sectional view illustrating an exemplary heat exchanger, including the stacked first fluid inlet manifolds 120, 124. In this example, the first fluid inlets are presumed to be cooler than the first fluid outlet, and hence the manifold 125 would be expected to be hotter than the inlet manifolds 120, 124. That is, the temperature differential between the inlet and outlet manifolds results from the thermal exchange between the first and second fluids, whereby the first fluid 31 increases in temperature as it passes from the inlet manifolds 120, 124 to the central outlet manifold 125.

Also, the first fluid 31 is presumed to be at an elevated pressure relative to the second fluid 27. Further, in this example the core assembly 70 is fastened to a base plate 35 with openings 54, 56 for the first fluid inlet and an opening 55 for the first fluid exit 47, which may be a pipe sealed to the manifold 125 and located at the base 35. Inlet pipes 45, 46 are sealed to the manifolds 120, 124. The pipes 45, 46, and 47 may be via a flange of normal joining means to enable the supply of the first fluid to and from the heat exchanger.

The opening 55 may be oversized with respect to the conduit 47 and the gap there between may be filled with an insulating material to prevent a loss of heat from the core 70. The openings 54 and 56 may be oversized with respect to the 45 and 46, respectively, to permit the core 70 to freely expand during heating.

The internal pressure of the first fluid 31 is counteracted by threaded tie-rod 1, installed in each of the manifolds 120 and 124. The tie-rods 1 pass through an upper structural spoked arm or "spider" 16 and a similar spoked arm 10 to enable the stack of cells to be clamped or compressed with a modest pre-load by turning tension nut 4. A pressure head, cap, or plate 3 is installed on both cool inlet manifolds 120, 124, leaving the opposite end for the intake piping 45, 46. A shoulder, flange or tab 37 on the pipe 45 and a tab 48 on the pipe 46 provide a means of aligning and supporting the core 70 on the base. It will be recognized by one skilled in the design of high temperature equipment that there are various means to enable low resistance slippage between tabs 37, 48 and respective pipes 45, 46 to accommodate thermal growth of the heat exchange core.

The stacked manifold 125 also contains the high pressure first fluid and, if exposed to higher temperature, must be permitted to expand freely to accommodate thermal expansion. A beam or structural plate 7 is positioned to span between the heads 3 on the opposite ends of the core 70, and passes over a manifold head 12 in the center of the core. The pressure load acting on the head or cap 12 is braced by the beam 7. Linkages 38 and 39, which are preferably flexible straps or cables, connect each head 3 to the beam 7. By using a flexible linkage 38, 39, the width of the core 70 can freely expand during heating of the heat exchange core, while at the same time providing tension the between beam and the outer manifolds 120 and 124 to distributing the pressure load in the central manifold 125 to outer manifolds 120 and 124, which, in turn, are reinforced via the tie rods 1 or other reinforcement members.

Accommodation of the axial thermal expansion of the manifold 125 may be provided by employing a flexible bellows 5 between the central manifold and the beam 7. In this case the carrier beam 7 is relatively stiff and the differential thermal expansion of the manifold 125 relative to the manifolds 120 and 124 acts to compress the bellows 5. Alternatively, a spring may be used in place of the bellows 5 wherein expansion of the manifold 125 compresses the spring.

An alternative arrangement eliminates the bellows 5, allowing the head 12 to bear directly on the beam structure 7. In this case, the carrier beam 7 should be designed to have a certain flexibility to allow a controlled deflection of the beam 7. The deflection should equal the differential thermal expansion which occurs between the hot, outlet manifold 125 relative to the cooler inlet manifolds 120 and 124. The deflection of the beam 7 will depend on the application, and should be engineered to cause a sufficiently small compressive stress in the core 70 as well as a low beam stress.

Though the fluid directions of the first and second fluids is presented for illustration in a certain direction, it will be recognized by those skilled in the design of heat exchangers that the respective flow directions may be reversed for certain applications. In such cases, the manifolds 120 and 124 might be of higher temperature than the center manifold 125. For this requirement, the flexible bellows 5 or flex-beam 7 would be located in the manifolds 120 and 124 and the cool tie-rod 1 would clamp the center manifold 125.

The invention has been described with reference to the preferred embodiments. Modifications and alterations will occur to others upon a reading and understanding of the preceding detailed description. For example, in common applications it should be clear to one skilled in the design of pressurized heat exchangers that either or both ends of the manifolds 120, 124, 125 may be configured as open on either end so as to facilitate practical piping requirements, without changing the principals of this invention. Also, an alternative to the internal tie-rods 1 may be a case-like structure configured to surround said manifold stacks 120 and 124. Also, it will be recognized to those skilled in the art of heat exchanger manufacturing that the first, second, and third manifolds, cut or formed into said first and second plates may be non circular in cross-sectional shape. Such common shapes might be an arced edge with a flat side forming an approximate "D-shape", or said cut-outs might be substantially rectangular or other polygonal shape, e.g., with radiused corners, or other geometric configuration. It is intended that the invention be construed as including all such modifications and alterations insofar as they come within the scope of the appended claims or the equivalents thereof.

Having thus described the preferred embodiments, the invention is now claimed to be:

1. A heat exchange device for effecting a transfer of heat between a first fluid and a second fluid, said heat exchange device comprising a plurality of heat exchange cells in a stacked arrangement, said heat exchange device defining a first manifold, a second manifold, and a third manifold disposed intermediate the first and second manifolds, each of said heat exchange cells comprising:

an upper cell plate having an exterior facing surface and an interior facing surface opposite the exterior facing surface, said upper cell plate having a first upper manifold aperture, a second upper manifold aperture, a third upper manifold aperture, and an upper peripheral edge bounding said upper cell plate;

a lower cell plate having an exterior facing surface and an interior facing surface opposite the exterior facing surface, said lower cell plate having a first lower manifold aperture, a second lower manifold aperture, a third lower manifold aperture, and a lower peripheral edge bounding said lower cell plate;

said lower cell plate juxtaposed with said upper cell plate so that the first lower manifold aperture is aligned with the first upper manifold aperture, the second lower manifold aperture is aligned with the second upper manifold aperture, and the third lower manifold aperture is aligned with the third upper manifold aperture;

the upper peripheral edge joined to the lower peripheral edge to define a cell peripheral edge;

the interior facing surface of the upper cell plate facing and spaced apart from the interior facing surface of the lower cell plate to define a first interior volume extending between the first manifold the third manifold and a second interior volume extending between the second manifold and the third manifold;

said first interior volume having a first cell inlet and a first cell outlet and defining a first fluid passageway for the first fluid between the first cell inlet and the first cell outlet;

said second interior volume having a second cell inlet and a second cell outlet and defining a second fluid passageway for the first fluid between the second cell inlet and the second cell outlet;

a first heat transfer matrix positioned within said first interior volume, a second heat transfer matrix positioned within said second interior volume, a third heat transfer matrix attached to the exterior surface of said upper cell plate between said first upper manifold aperture and said third upper manifold aperture, a fourth heat transfer matrix attached to the exterior surface of said upper cell plate between said second upper manifold aperture and said third upper manifold aperture, a fifth heat transfer matrix attached to the exterior surface of the lower cell plate between said first lower manifold aperture and said third lower manifold aperture, and a sixth heat transfer matrix attached to the exterior surface of the lower cell plate between said second lower manifold aperture and said third lower manifold aperture;

a first upper manifold ring on the exterior surface of the upper cell plate and circumscribing the first upper manifold aperture;

a second upper manifold ring on the exterior surface of the upper cell plate and circumscribing the second upper manifold aperture;

a third upper manifold ring attached to the exterior surface of the upper plate and circumscribing the third upper manifold aperture;

a first lower manifold ring attached to the exterior surface of the lower plate and circumscribing the first lower manifold aperture;

a second lower manifold ring attached to the exterior surface of the lower plate and circumscribing the second lower manifold aperture;

a third lower manifold ring attached to the exterior surface of the lower plate and circumscribing the third lower manifold aperture;

during operation, the first fluid, contained within said first, second, and third manifolds, having a higher pressure than the second fluid, and each of said first, second, and third manifolds having a closure member closing a first end thereof, said first, second, and third manifolds being open at a second end thereof;

a first tension member for preventing gross distortion of the first manifold when the first manifold is subjected to a pressure load;

a second tension member for preventing gross distortion of the second manifold when the second manifold is subjected to a pressure load;

a lateral beam having a first end coupled to the closure of said first manifold and a second end coupled to the closure of said second manifold; and said closure of said third manifold bearing against said lateral beam at a position intermediate the first and second ends of the lateral beam.

2. The heat exchange device of claim 1, wherein each of said first upper manifold ring, said second upper manifold ring, said third upper manifold ring, said first lower manifold ring, said second lower manifold ring, and said third lower manifold ring is selected from the group consisting a separately formed ring and an integrally formed ring.

3. The heat exchange device of claim 1, wherein said third manifold is centrally positioned between said first and second manifolds.

4. The heat exchange device of claim 1, wherein each of the first, second, and third manifolds have a cross-sectional shape independently selected from the group consisting of circular, rectangular, polygonal, and D-shaped.

5. The heat exchange device of claim 1, further comprising:

said first tension member is selected from the group consisting of a tie-rod disposed within the first manifold and a rigid case disposed exteriorly about the first manifold; and said second tension member is selected from the group consisting of a tie-rod disposed within the first manifold and a rigid case disposed exteriorly about the second manifold.

6. The heat exchange device of claim 1, further comprising:

said lateral beam having a rigidity which is sufficient to prevent gross displacement of the third manifold when the third manifold is subjected to a pressure load.

7. The heat exchange device of claim 6, further comprising:

a resilient member disposed between the third manifold and said lateral beam, said resilient member compressible to accommodate axial expansion of said third manifold.

8. The heat exchange device of claim 7, further comprising:

said resilient member selected from the group consisting of: a spring member; and, a pressure activated bellows fluidically coupled to said third manifold.

9. The heat exchange device of claim 1, further comprising:

said lateral beam having a flexibility which is sufficient to accommodate axial expansion of said third manifold.

10. The heat exchange device of claim 1, further comprising:

said first and second manifolds are each inlet manifolds and said third manifold is an outlet manifold, wherein during operation of said heat exchange device the first fluid is substantially heated as it flows from said first and second manifolds to said third manifold.

11. The heat exchange device of claim 1, further comprising:

a first land adjacent the first manifold;

a second land adjacent the second manifold; and third and fourth lands for receiving the second fluid, the first and second lands adjacent to the third manifold.

12. The heat exchange device of claim 11, further comprising:

said first and second lands on a transverse side of the heat exchange device and the third and fourth lands on a second transverse side of the heat exchange device opposite the first transverse side.

13. The heat exchange device of claim 1, further comprising:

said first cell inlet is defined between the first upper manifold aperture and the first lower manifold aperture;

said first cell outlet is defined between the third upper manifold aperture and the third lower manifold aperture;

said second cell inlet is defined between the second upper manifold aperture and the second lower manifold aperture said second cell outlet is defined between the third upper manifold aperture and the third lower manifold aperture.

* * * * *